US005203837A

United States Patent [19]

Madic et al.

[11] Patent Number: 5,203,837

[45] Date of Patent: Apr. 20, 1993

[54] BALANCED LIFTING CRANE

[76] Inventors: Bosko Madic, 25 Maybelle Ave., Apt. 811, Etobicoke, Ontario, M9A 4Y1, Canada; Vojislav Terzic, 4700 Ruth Ann Street, Harrisburg, Pa. 17109

[21] Appl. No.: 782,590

[22] Filed: Oct. 25, 1991

[51] Int. Cl.[5] ..... B66C 23/72; B66C 23/76; B66C 23/04

[52] U.S. Cl. ..... 212/195; 212/196; 212/197; 212/198; 212/175; 212/230; 212/248; 414/917

[58] Field of Search ..... 212/195, 196, 248, 156, 212/178, 191, 197, 198, 230, 232; 414/917

[56] References Cited

U.S. PATENT DOCUMENTS

| | | | |
|---|---|---|---|
| 742,044 | 11/1903 | Low | 212/197 |
| 911,093 | 2/1909 | Van Wie | 212/196 |
| 911,632 | 2/1909 | Van Wie | 212/197 |
| 3,282,441 | 11/1966 | Stauffer | 212/230 |
| 3,300,059 | 4/1965 | Grey | 212/230 |
| 4,218,171 | 8/1980 | Guinot | 414/917 |

FOREIGN PATENT DOCUMENTS 3020562 12/1981 Fed. Rep. of Germany ..... 212/197

*Primary Examiner*—Joseph F. Peters, Jr.
*Assistant Examiner*—Kenneth Lee
*Attorney, Agent, or Firm*—Richard C. Litman

[57] ABSTRACT

A crane has a generally horizontally disposed main boom arm centrally pivotally mounted on a turret supported for rotation atop a central column. The main boom arm supports a load at one end and a counterweight at its other end. The main boom arm load support end has a depending vertical arm, linked in parallelogram fashion with the turret, and with a lower rotatable load carrying swing arm movable through a full 360° arc without interference with the column and turret. The column may be mounted on a dolly. A rack and worm pinion arrangement are provided on either the main boom or the counterweight for adjusting the distance of the counterweight from the column and turret, thus to balance the crane in a vertical plane.

8 Claims, 4 Drawing Sheets

BALANCED LIFTING CRANE

FIELD OF THE INVENTION

This invention relates to cranes, more particularly to those having an adjustable counterweight and further providing compound axes of rotation, so that a load may be picked up and set down at any point within a maximum radius provided by the axes of rotation.

U.S. Pat. Nos. 3,721,416 issued Mar. 20, 1973 to Noel G. Gondreau and 4,659,278 issued Apr. 21, 1987 to Joachim Doege et al illustrate parallelogram linkage crane assemblies, employing piston cylinder counterbalancing in the former patent and a movable counterweight in the latter. However, neither patent shows a load support arm movable through compound axes of rotation in a horizontal plane nor the uncomplicated counterbalancing structure of the instant invention. Relatively large capacity cranes having counterweights movable through limited vertical arcs are disclosed in U.S. Pat. Nos. 4,491,227 issued Jan. 1, 1985 to Lillian Buzzichelli et al and 4,867,321 issued Sep. 19, 1989 to Serge Montgon. These patents do not teach counterweight adjustment in a generally horizontal plane, along the long axis of a crane main boom arm. Additionally, the prior art does not show a parallelogram linkage balanced crane with a dolly or the like support for mobility of the crane, whether supporting a load or not.

SUMMARY OF THE INVENTION

The present invention provides a compact, highly mobile crane capable of picking up or setting down a load at any selected point within reach of the crane, including areas in very close proximity to the crane's central column. The crane has a central column seated on a base which, in turn, may be mounted on a dolly so that the crane is highly mobile and may be moved from place to place. A main boom is pivotally mounted atop a turret which is rotatably mounted on the crane column, the main boom having a first boom arm with a depending, vertical load support arm connected in parallelogram fashion to the turret, and an oppositely extended second boom arm supporting a counterweight. The distance of the counterweight from the column and turret is adjustable either by movement of the second boom arm back and forth with the counterweight affixed to the second boom arm or by movement of the counterweight along the second boom arm. A rotatable swing arm depends from the vertical load support arm and includes an outwardly projecting, rotatable load support arm movable through a full circle thus to impart maximum load positioning capability to the crane. In other words, with the main boom movable through a full circle and the projecting load support arm of the swing arm movable through a smaller diameter circle, a load may be picked up and set down anywhere in an area between the crane column and a point defined by the outermost reach of the projecting load support arm.

Accordingly, one of the objects of the invention is to provide a simple, compact, mobile and yet sturdy crane.

Another object is to provide a crane having a load support arm depending from a crane main boom and rotatable independently of rotation of the main boom arm so that a load may be picked up and set down anywhere in an area from the center of the crane outwardly to the maximum reach of the rotatable load support arm.

A further object is to provide a compact, mobile crane with a counterweight which may be adjusted either by moving a crane main boom section to which the counterweight is affixed or by moving the counterweight along a fixed main boom section.

With these and other objects in view which will more readily appear as the nature of the invention is better understood, the invention consists in the novel combination and assembly of parts hereinafter more fully described, illustrated, and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
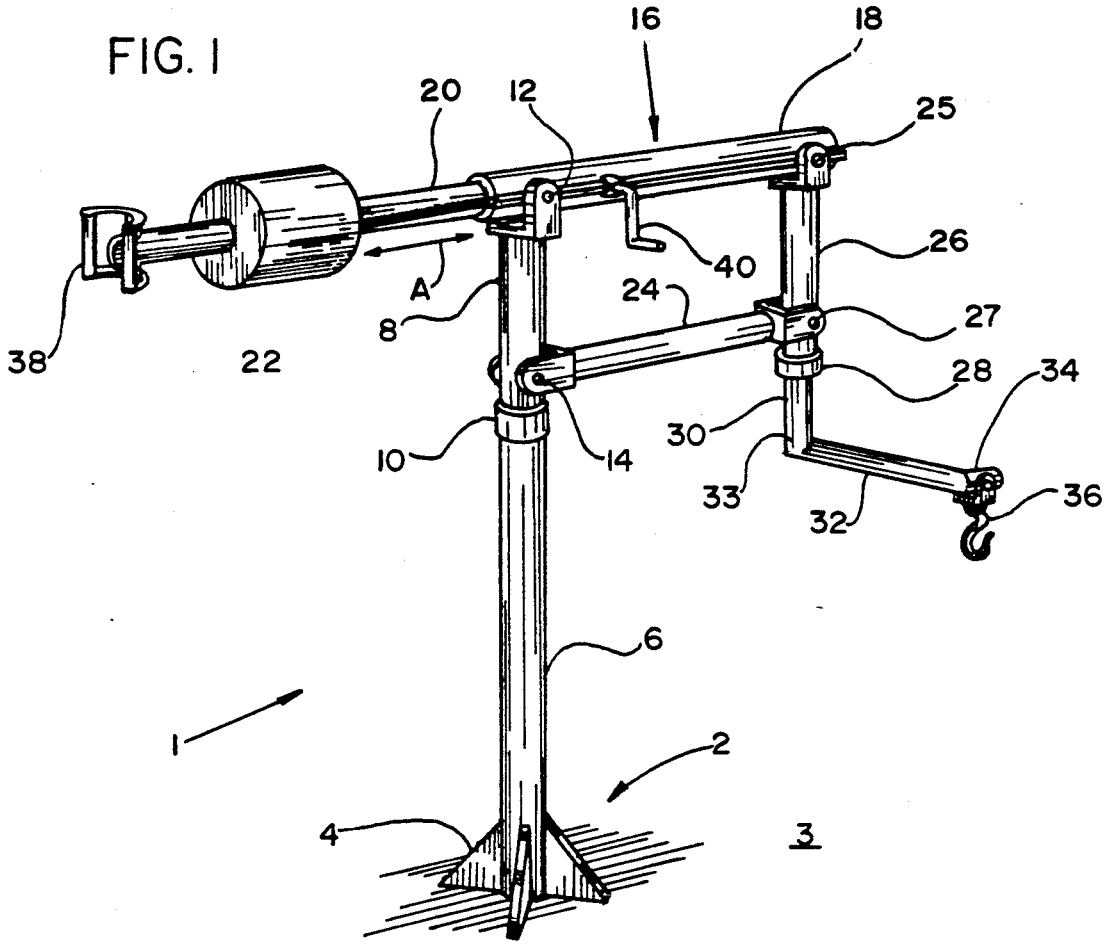
FIG. 1 is a perspective view of the crane.

Referring now to FIG. 1, the crane 1 may be seen to rest on a base 2 including a plurality of support wings 4 which steady the crane on a supporting surface 3. A central column 6 has an upper turret 8 rotatably supported on a bearing 10. The upper turret 8 has pivots 12, 14 at which points a main boom arm 16 and a stabilizer bar 24, respectively, are attached.

The main boom arm 16 comprises a first boom arm 18 for carrying a load and an adjustably movable (FIGS. 1 and 5) or fixed (FIGS. 5 and 9) second boom arm 20. The second boom arm 20 supports a counterweight 22 which is either fixed to arm 20 or adjustable therealong, in a manner to be explained below.

Figure 6:
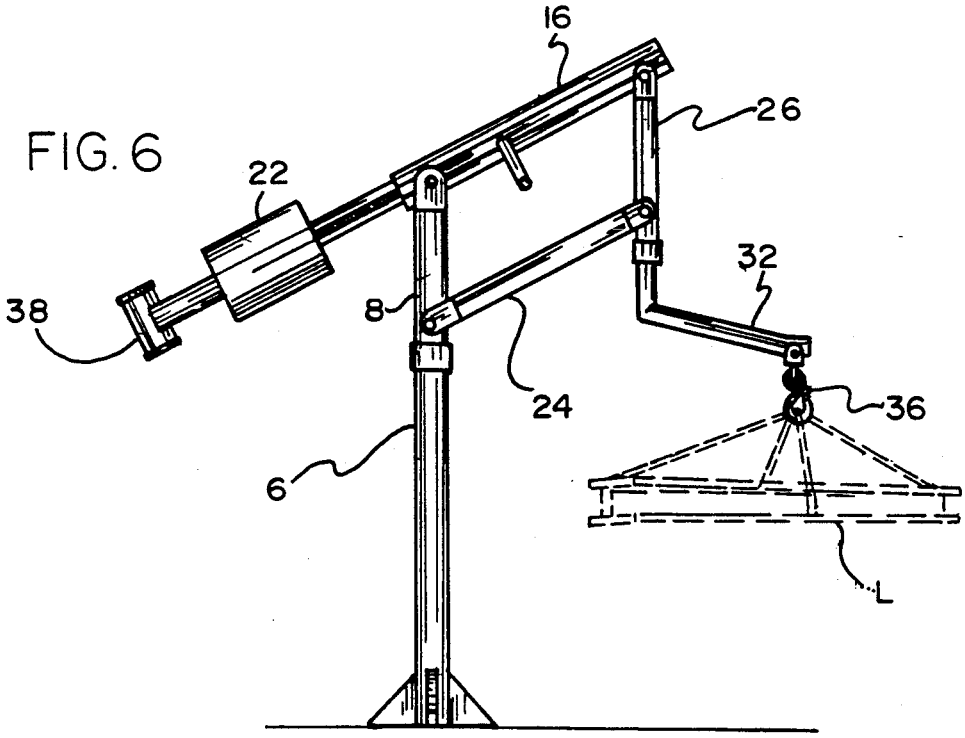
FIG. 6 is a side elevational view illustrating the extent of inclination of the boom arms while lifting a load.
Figure 7:
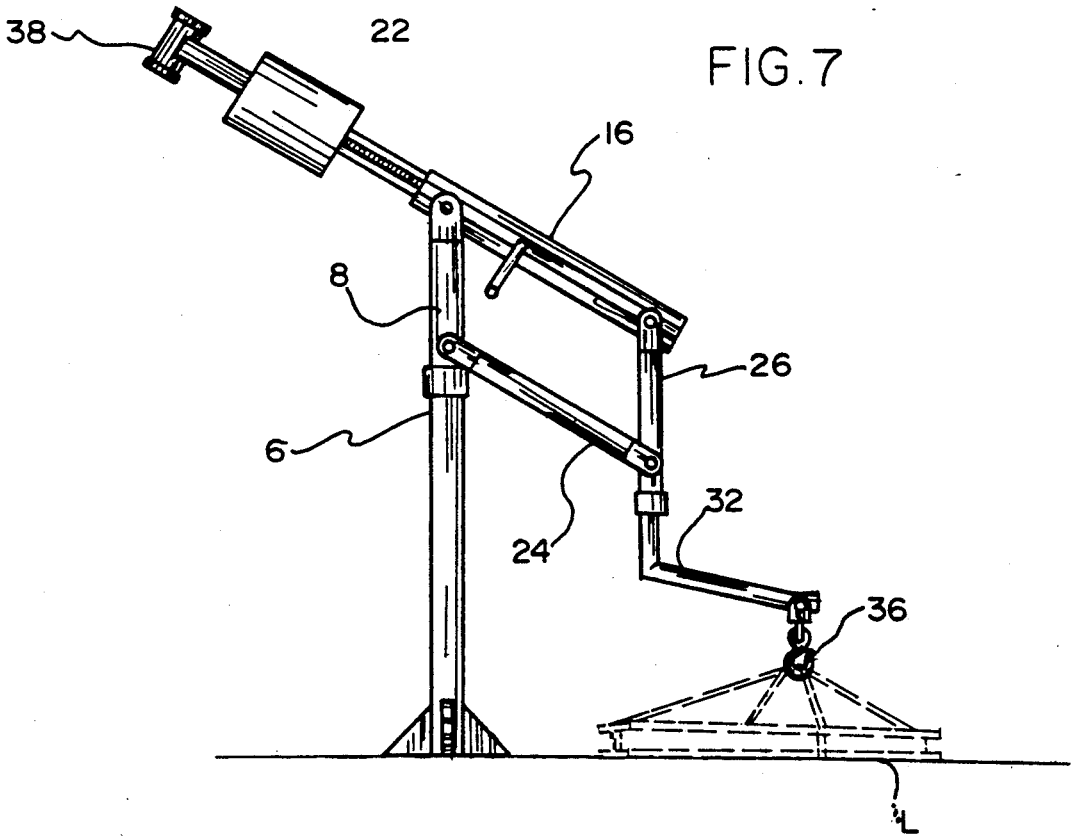
FIG. 7 is a side elevational view illustrating the extent of inclination of the boom arms while lowering a load.

A vertical load support arm 26 is pivotally supported from first boom arm 18 of the main boom 16 at a point 25, and similarly is attached to the stabilizer bar 24 at pivoting connection 27. The vertical load support arm 26, combined with the first boom arm 16, stabilizer bar 24, and the central column turret 8, defines a parallelogram linkage assembly operative in otherwise conventional fashion and as illustrated in FIGS. 6 and 7.

The vertical load support arm 26 has a bearing 28 which rotatably supports a lower swing arm structure including a vertically disposed, short length arm 30 having a projecting, load support arm 32, arms 30, 32 being interconnected by an elbow 33. At its distal end 34, the projecting arm may have a hook 36 for carrying a load L, as shown in FIGS. 6 and 7. Although a hook 36 is shown, other attachments for suspending a load and known in the art could be used.

Figure 3:
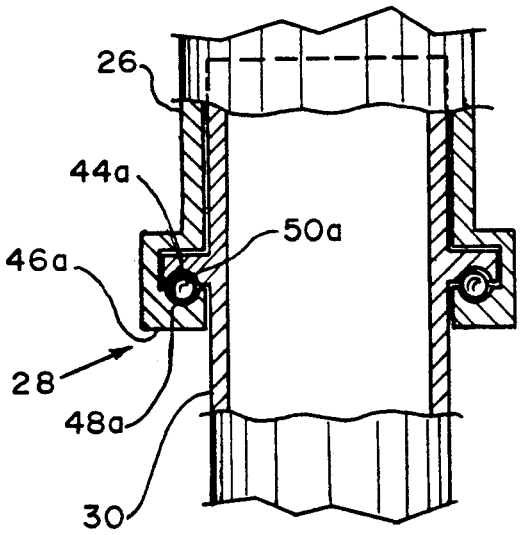
FIG. 3 is a cross section detail of the bearing attachment of the crane projecting load support arm from a vertical load support arm depending from the crane main boom.
Figure 2:
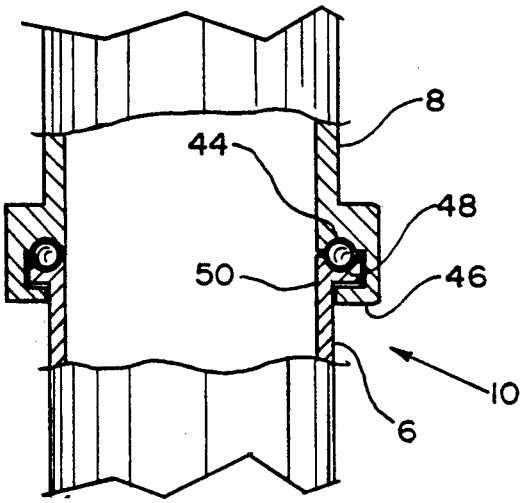
FIG. 2 is a cross section detail of the bearing support for the crane turret on the crane column.

Referring now to FIGS. 2 and 3, the bearings 10, 28 of central column 6 and vertical load support arm 26, respectively, may be of a type well known in the mechanical arts. The lower end of turret 8 of the central post 6 includes an upper race 44 which cooperates with a lower race 48 disposed in the upper end of column 6. Turret 8 revolves about its long axis on ball bearings 50. The lower end of turret 8 further includes a retaining rim 46 which surrounds the race 48, maintaining turret 8 in a fixed, although rotatable, vertical relationship to the central column 6. In similar fashion, and as shown in FIG. 3, the vertical load support arm bearing 28, seen in FIG. 3, has an upper race 44*a*, cooperating lower race 48*a*, and ball bearings 50*a*, as well as a lower retaining rim 46*a*.

Figure 4:
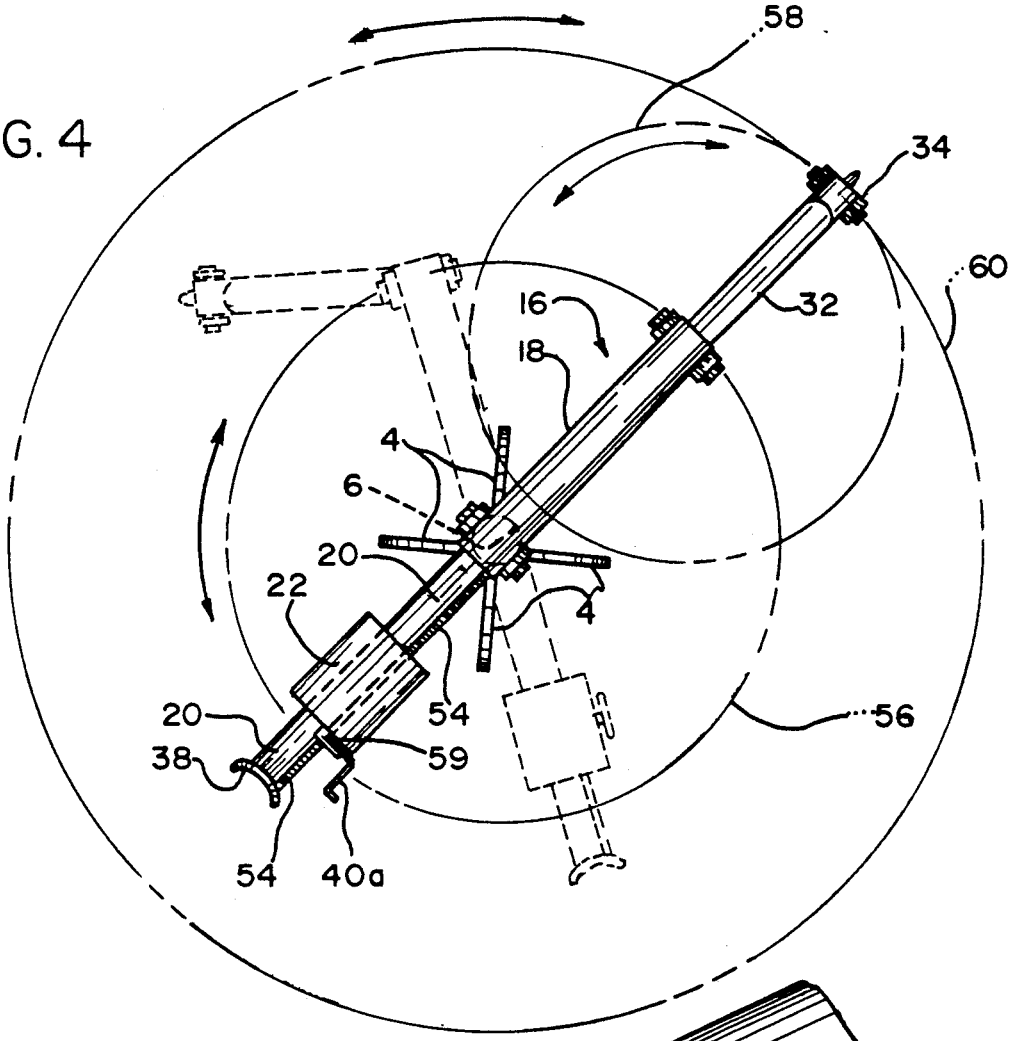
FIG. 4 is a plan view of the crane illustrating the arcs of movement of both the crane main boom and the projecting, rotating load support arm as well as the embodiment wherein the crane counterweight is movable along a fixed main boom arm.

When the main boom arm 16 rotates on the central column 6, it may swing through 360 degrees, defining a circumference of rotation 56, best see in FIG. 4. The projecting load support arm 32 of the vertical arm 26, independently of the main boom arm 16, rotates about its own axis, defining circumference 58 at its distal end 34. A maximum circumference of rotation 60 is created by the combined length of first boom arm 16 and the farthest reach of projecting load support arm 32. As may be seen by following circumference 58, the independent rotation of the projecting arm 32 permits its distal end 34 to approach very nearly the crane central column 6. The projecting arm 32 is sufficiently short to allow its distal end 34 and load attachment hook 36 to pass by the central column 6 without interference.

When a load L is lifted or lowered, the main boom arm 16, and stabilizer bar 24 assume an inclination, as shown in FIGS. 6 and 7. The vertical arm 26, held parallel to central column 6 by stabilizer bar 24, maintains projecting load support arm at a fixed distance from the central column 6 while the rotatable projecting load support arm 32 is free to roam the entire area between central column 6 and a maximum reach defined by circumference 60. This ability to work in tight quarters, together with the ability to lower a load at any point within a maximum area defined by circumference 60 (FIG. 4), makes the crane 1 very useful and practical.

Figure 8:
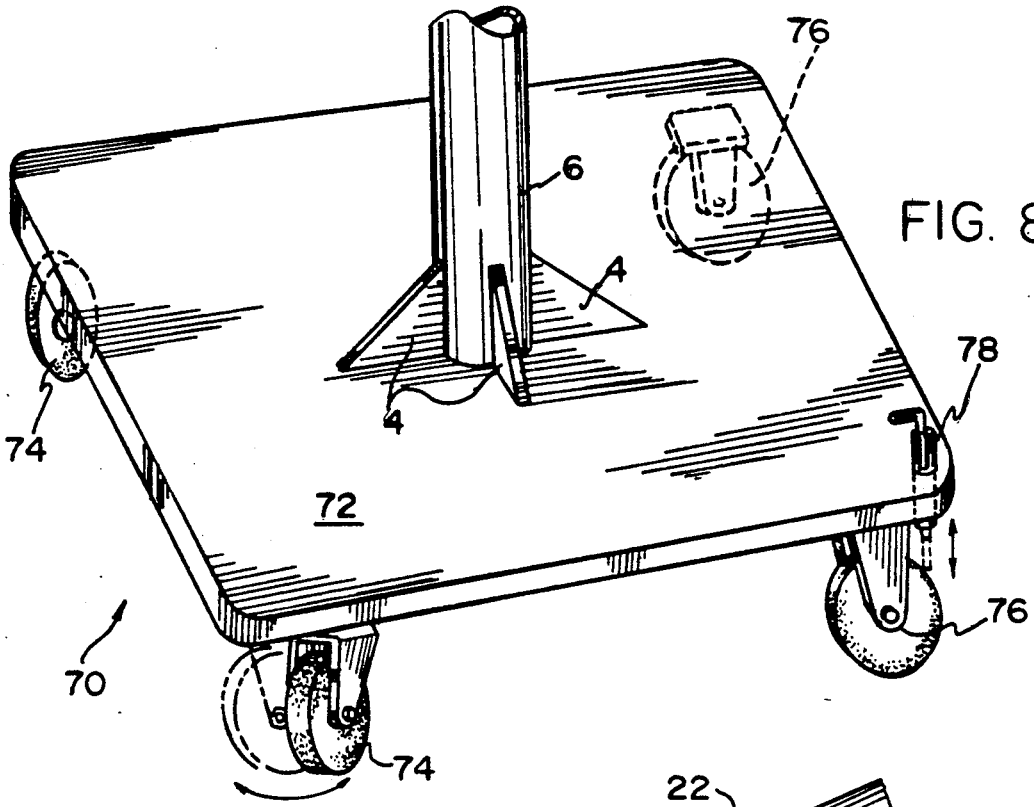
FIG. 8 is a perspective view illustrating a dolly support for the crane.

Another advantage of the present invention is its mobility which may be provided by a dolly 70, shown in FIG. 8. Dolly 70, by way of example, includes a generally rectangular support platform 72 and fore and aft support wheels or casters 74, 74 and 76, 76, respectively. The dolly wheels may be mounted in "grocery cart" fashion, each fore wheel 72 being freely rotatable about its vertical mounting axis and each aft wheel being fixed for rotation in a vertical plane only, so that the crane may be moved from place to place in a more controlled fashion, whether supporting a load L or empty. If desired, one or more uncomplicated and otherwise conventional wheel engaging parking brakes 78 may be provided to stabilize the dolly and crane at a position to do work. The wheel and brake assembly just described is simply illustrative and other structures are known in the art.

Figure 5:
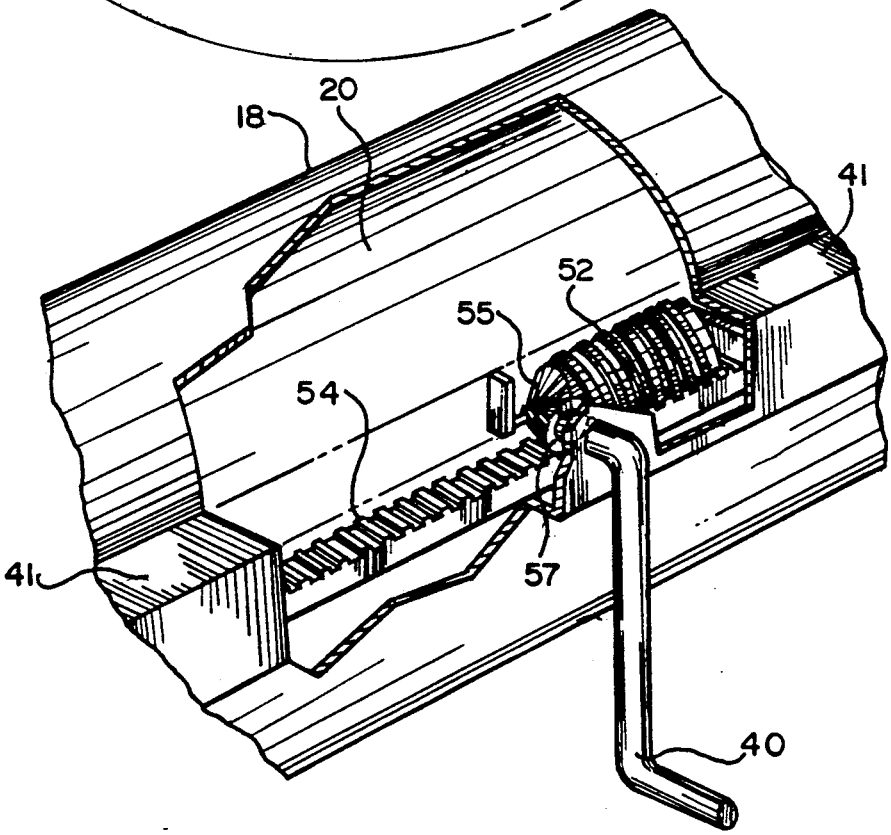
FIG. 5 is a cutaway perspective detail of the embodiment wherein the counterweight is adjustable by moving a boom arm section on which the counterweight is affixed and as shown in FIG. 1.

In a preferred embodiment, and as best shown in FIGS. 1 and 5, counterweight 22 is affixed to second boom arm 20 which, in turn, is slidably, telescopically received in first boom arm 18. A crank 40 is journalled through a side wall of an extended length box enclosure 41, which is open on a side facing second boom arm 20 and houses a rack 54 fixed along the length of second boom arm 20. A pinion in the form of a worm gear 52 is intermeshed with rack 52 and driven from crank or handle 40 through a transmission, e.g., a pair of bevel gears 55, 57, fixed to the worm gear 52 and handle 40, respectively. The reason the pinion of the rack and pinion assembly just described is in the form of a worm gear 52 is to impart self braking to the crane counterweight adjustment. Rotation of the handle 40 will move the second boom arm 20 back and forth in the direction of arrows A as shown in FIG. 1, thus to vary the distance of counterweight 22 from the column 6 and turret 8 and balance the crane with respect to any load carried on hook 36. When the load is balanced by appropriate movement of arm 20 through rotation of handle 40, the arm 20 and counterweight 22 will remained fixed in the adjusted position because any unbalancing axial force imparted from rack 54 to worm gear 52 will not cause the worm gear to rotate due to the inherent mechanical advantage provided by a worm gear. Of course, other types of self braking mechanisms could be employed (e.g., a friction clutch assembly) but the worm and associated gear members just described are most cost effective to accomplish the task.

Figure 9:
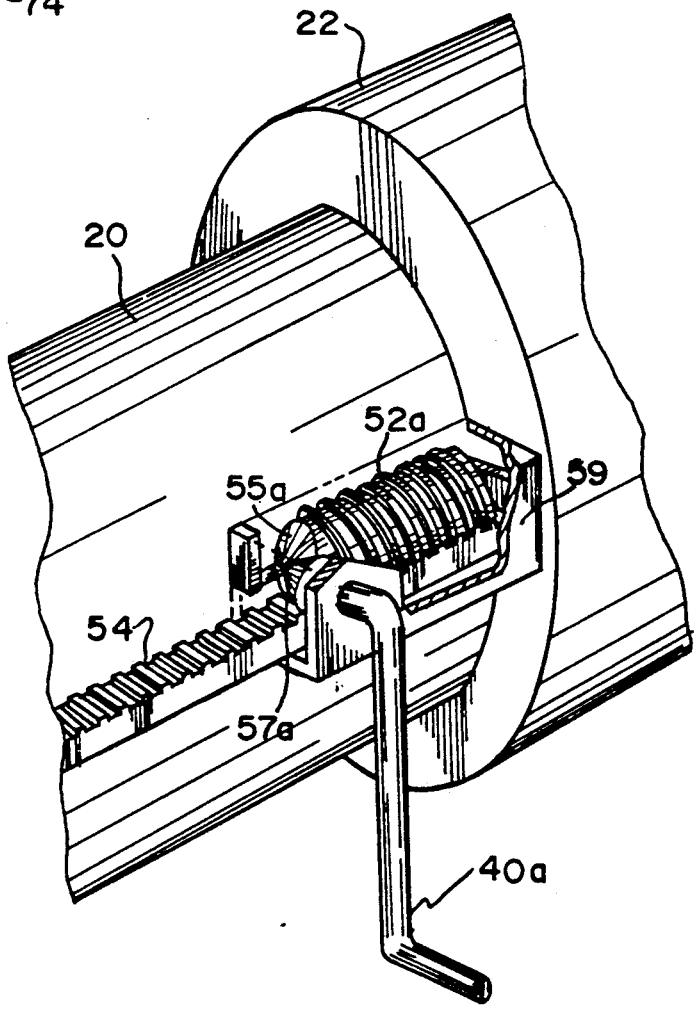
FIG.9 is a cutaway perspective detail similar to FIG. 5 but showing a gear arrangement for moving the crane counterweight along a fixed section of the main boom.

Another embodiment of adjustment of counterweight 22, that is, adjusting the distance of counterweight 22 from column 6 and turret 8 in the direction of arrows A as shown in FIG. 1, is best shown in FIGS. 4 and 9. In this embodiment, second boom arm 20 is fixed to first boom arm 18 and counterweight 22 is moved along second boom arm by a gear and handle assembly similar to that shown in FIG. 5. The same rack 54 is provided along the length of second boom arm 20 but extends to the outer end of the arm as shown best in FIG. 4. A casing or housing 59 is affixed to counterweight 22 and encloses bevel gears 59*a*, 57*a* and worm gear 52*a* which is intermeshed with rack 54. Handle 40*a* is journalled through a side wall of casing 59. Of course, rotation of handle 40*a* causes counterweight 22 to travel along second boom arm 22 through the action of bevel gears 57*a*, 55*a*, and worm pinion gear 52*a* acting on rack 54.

In yet another alternative embodiment, manual maneuvering may be provided, as illustrated by the handle 38 of FIG. 1, affixed to the rear terminal end of second boom arm 20. Additionally, manually operation to rotate the main boom arm 16 about the center column 6, or manually operation to rotate the projecting load support arm 32 about the vertical arm 26 are also contemplated. With manual maneuvering and manual counterweight adjustment, operation and even the safety of the crane 1 remain outside the influences of power failure, hydraulic system integrity, and similar external sources of trouble.

It is to be understood that the present invention is not limited to the sole embodiments described above, but encompasses any and all embodiments within the scope of the following claims.

We claim:

1. A balanced lifting crane comprising:

a. a vertical column having a base to support said column on a surface and turret bearing means on the top of said column;

b. a turret mounted on said turret bearing means such that said turret is free to rotate through 360 degrees with respect to said column;

c. a main boom centrally pivotally mounted atop said turret, thus to define first and second boom arms to either side of the center of said main boom;

d. a vertical support arm having an upper end and a lower end, the support arm upper end being pivotally attached to the free end of said first boom arm;

e. a stabilizer bar having a first outer end pivotally attached to said turret mesially thereof and a second outer end attached to said vertical load support arm mesially thereof, such that said stabilizer arm is parallel to said first boom arm, said first boom arm, stabilizer bar, turret and vertical load support arm define a parallelogram arm system and thus confine said vertical load support arm to substantially vertical movement only;

f. a load supporting swing arm depending from said vertical load support arm, there being a swing arm bearing assembly means disposed between said vertical load support arm and said swing arm for free rotation of said swing arm about said vertical load support arm through 360 degrees in a horizontal plane, said swing arm further comprising a short length arm below said swing arm bearing means, a projecting load support arm extended outwardly from said short length arm and an elbow interconnecting said short length arm and said projecting load support arm, said projecting load support arm, stabilizer bar and first boom arm being dimensioned and configured such that said projecting load support may be rotated through a full 360 degree arc without interference with said column or turret;

g. counterweight means disposed on said second boom for counterbalancing a load carried by said horizontal load support arm;

h. means operable for adjusting the distance of said counterweight from said column and turret and being affixed to one of said first boom arm and said counterweight; and i. said second boom arm is slidably, telescopically received within said first boom arm, said counterweight is fixed to said second boom arm near an end thereof remote from said first boom arm, and said means for adjusting the distance of said counterweight with respect to said column and turret is affixed to said first boom arm and comprises handle means, externally of said first boom arm and journalled therethrough, and gear means internally of said first boom arm in operative engagement with the telescopically received portion of said second boom arm, whereby rotation of said handle means imparts axial movement of said second boom arm with respect to said first boom arm.

2. The invention as claimed in claim 1 further comprising a dolly beneath and affixed to said column base.

3. The invention as claimed in claim 2 wherein said dolly is generally rectangular in configuration and includes wheels at the four corners thereof.

4. The invention as claimed in claim 3 wherein at least one of said wheels includes releasable parking brake means for stabilizing said crane and preventing movement thereof over a supporting surface.

5. The invention as claimed in claim 1 wherein the free end of said second boom arm comprises handle means for manually manipulating said crane main boom.

6. The invention as claimed in claim 1 wherein said gear means further comprises a rack gear along a major portion of the length of said second boom arm and a pinion gear in the form of a worm gear intermeshed with said rack gear, said gear means thus being self braking when said handle means is not being operated.

7. The invention as claimed in claim 1 wherein said second boom arm as fixed to said first boom arm and said means for adjusting the distance of said counterweight with respect to said column and turret is affixed to said counterweight and comprises handle means externally of said counterweight and gear means in operative engagement with said second boom arm whereby rotation of said handle means imparts axial movement of said counterweight with respect to said second boom arm and thus adjustment of the distance of said counterweight with respect to said column and turret.

8. The invention as claimed in claim 7 wherein said gear means further comprises a rack gear along the length of said second boom arm and through said counterweight and a pinion gear in the form of a worm gear intermeshed with said rack gear, said gear means thus being self braking when said handle means is not being operated.

* * * * *